United States Patent [19]

Scholten et al.

[11] Patent Number: 5,042,068

[45] Date of Patent: Aug. 20, 1991

[54] AUDIO SPATIAL EQUALIZATION SYSTEM

[75] Inventors: Mark A. Scholten, Rolling Meadows; Stanley R. Zachary, Roselle, both of Ill.

[73] Assignee: Zenith Electronics Corporation, Glenview, Ill.

[21] Appl. No.: 644,486

[22] Filed: Jan. 18, 1991

Related U.S. Application Data

[63] Continuation of Ser. No. 457,984, Dec. 28, 1989, abandoned.

[51] Int. Cl.[5] ..... H04S 1/00

[52] U.S. Cl. ..... 381/1; 381/28

[58] Field of Search ..... 381/1, 28

[56] References Cited

U.S. PATENT DOCUMENTS

| | | | |
|---|---|---|---|
| 4,149,036 | 4/1979 | Okamoto et al. | 381/1 |
| 4,192,969 | 3/1980 | Iwahara | 381/1 |
| 4,696,035 | 9/1987 | Torelli et al. | 381/1 |
| 4,700,389 | 10/1987 | Nakayama | 381/1 |
| 4,868,878 | 9/1989 | Kunugi et al. | 381/1 |
| 4,980,914 | 12/1990 | Kunugi et al. | 381/1 |

FOREIGN PATENT DOCUMENTS

| | | | |
|---|---|---|---|
| 0161500 | 9/1983 | Japan | 381/1 |

*Primary Examiner*—Jin F. Ng
*Assistant Examiner*—Sylvia Chen

[57] ABSTRACT

A television receiver includes a stereo amplifier having separate bass, treble and gain controls, for driving left and right channel loudspeakers. Separate bandpass circuits supply portions of the respective channel signals for phase inversion and feed back to respective summation circuits in the outputs of the corresponding opposite channel to produce an extended stereo effect. A switch simultaneously activates the syereo extender circuitry and operatively couples the bass and treble controls to the gain control for extending the frequency response characteristic and the volume level of the channels.

6 Claims, 1 Drawing Sheet

FIG. 1 (PRIOR ART)
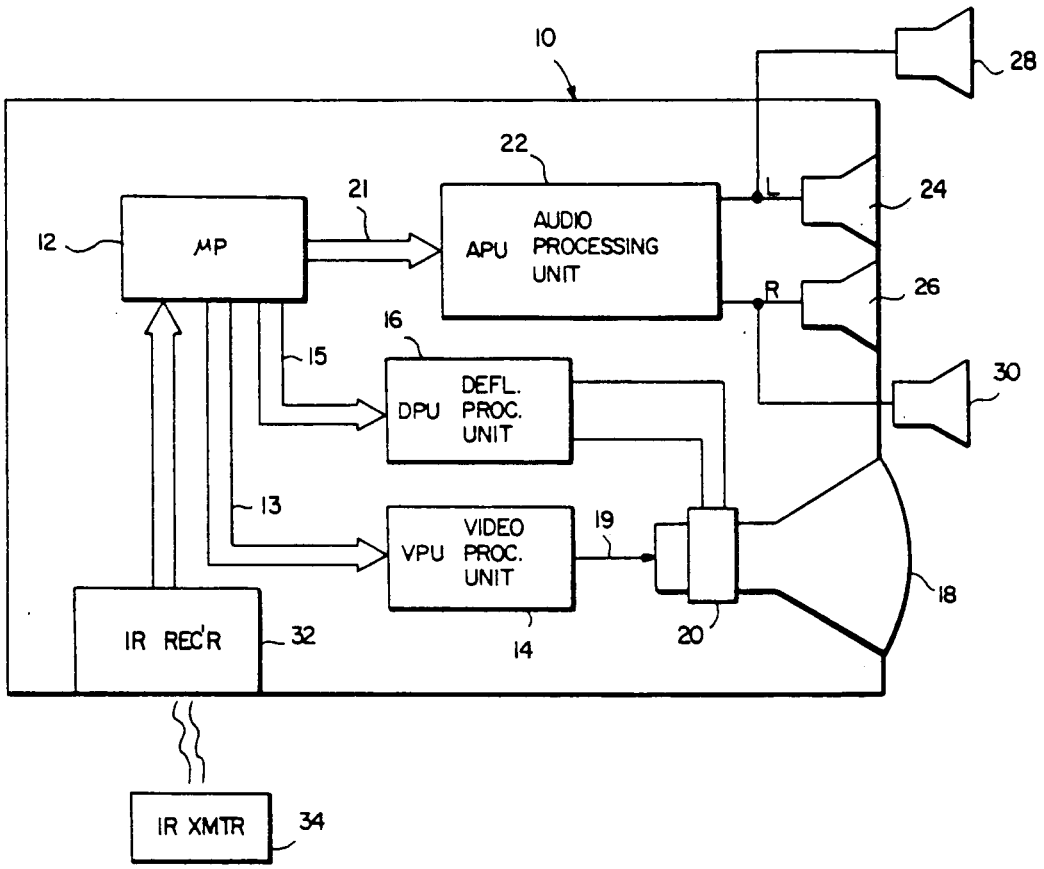
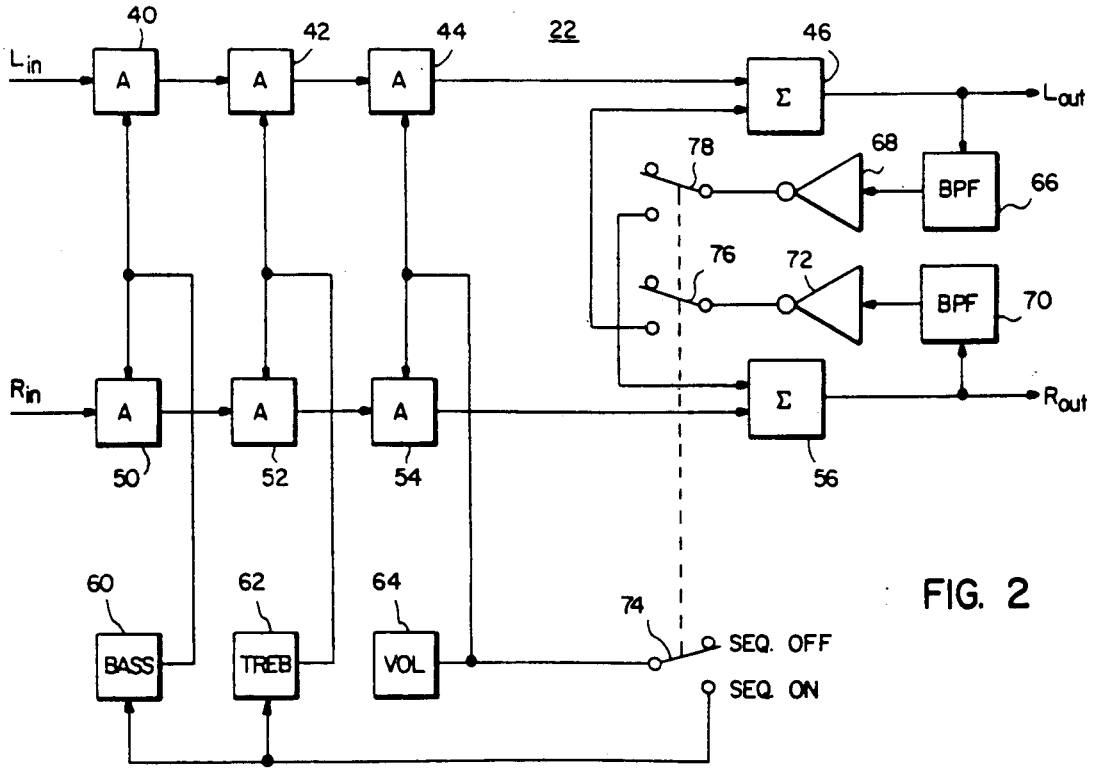
FIG. 2

AUDIO SPATIAL EQUALIZATION SYSTEM

This application is a continuation of application Ser. No. 457,984 filed Dec. 28, 1989 now abandoned.

BACKGROUND OF THE INVENTION AND PRIOR ART

This invention relates generally to stereo audio systems and particularly to an extended stereo system of improved spatial characteristics for use with stereo television receivers.

Stereo television receivers are well known in the art. The enhanced listening experience provided by stereo sound as compared with monaural sound is also well known and the benefit obtained from television stereo sound is equally dramatic. In many television installations separate, remotely situated loudspeakers help "spread the sound" over the room in an attempt to simulate the ambiance of a movie theater.

It has long been known that stereo sound may be enhanced by supplying a portion of out-of-phase left channel signal to the right channel and vice versa. This is commonly referred to as "extended stereo." The impression on the listener is that of "spreading the sound stage." It is also known that the frequency response of the human ear varies with changes in sound level. So-called loudness controls have often been used in preference to conventional gain controls, which have no appreciable affect on frequency response, for emphasizing the low and high frequencies in the reproduced sound signal at lower sound levels.

The present invention is based upon the discovery that the extended stereo effect can be substantially improved by simultaneously emphasizing both the high and low frequencies, relative to the middle frequencies, in the signal and by altering the overall sound amplitude level slightly when the stereo extender is activated. The resultant system has been referred to as "spatial equalization" (SEQ). The SEQ system may be implemented in software in a digital type stereo television receiver or with discrete conponents in a conventional analog type stereo television receiver.

OBJECTS OF THE INVENTION

A principle object of this invention is to provide a novel stereo audio system.

Another object of the invention is to provide a stereo television receiver with enhanced sound characteristics.

A further object of the invention is to provide an enhanced extended stereo system.

BRIEF DESCRIPTION OF THE DRAWINGS

These and other objects and advantages of the invention will be apparent from reading the following description in conjunction with the drawings, in which:

FIG. 1 represents a partial block diagram of a prior art stereo television receiver; and FIG. 2 is a block diagram of a stereo amplifier constructed in accordance with the invention.

DESCRIPTION OF THE PREFERRED EMBODIMENT

Referring to FIG. 1, a prior art digital stereo television receiver 10 conventionally includes a microprocessor 12, a video processing unit (VPU) 14, a deflection processing unit (DPU) 16, a picture tube 18 with a yoke 20 and an audio processing unit (APU) 22. A bus 13 couples microprocessor 12 with VPU 14, a bus 15 couples microprocessor 12 to DPU 16 and a bus 21 couples microprocessor 12 to APU 22. Video signals are supplied over a suitable connection 19 to picture tube 18 and DPU 16 supplies appropriate deflection voltages to yoke 20. The left and right channel signal outputs of APU 22 are supplied to respective left and right loudspeakers 24 and 26 situated within the television receiver and to external left and right loudspeakers 28 and 30, respectively, remotely located from the television receiver. An IR receiver 32 is coupled to microprocessor 12 and is capable of receiving IR, i.e. infrared, signals from an IR transmitting 34. As is conventional practice, the IR transmitter 34 includes a keyboard for launching a variety of control signals for controlling various functions of TV receiver 10.

In FIG. 2, the stereo amplifier portion of APU 22 is shown, as modified to incorporate the present invention. A left channel input signal Lin is coupled to a series of amplifier stages A, labelled 40, 42 and 44 and to a summer 46. Similarly, a right channel input signal Rin is coupled to a series of amplifier stages A, labelled 50, 52 and 54 and to a summer 56. A bass control arrangement 60 controls amplifiers 40 and 50, a treble control 62 controls amplifiers 42 and 52 and a volume control 64 controls amplifiers 44 and 54. As is conventional practice, bass control 60 alters the low frequency response of amplifiers 40 and 50 to emphasize or deemphasize low frequencies in the signals translated by the right and left channels. Similarly, treble control 62 alters the high frequency response of amplifiers 42 and 52 to change the relative emphasis of the high frequencies translated therethrough and the volume control 64 affects the overall gain of the signals without substantial effect on the right and left channel frequency response.

In accordance with the invention, the output of the left channel is supplied to a bandpass filter 66 which in turn supplies an inverter 68, the output of which is coupled to a switch blade 78. Similarly, the output of the right channel is coupled to a bandpass filter 70 that in turn supplies an inverter 72 which is coupled to a switch blade 76. The bandpass filters accentuate the high and low frequencies of the audio signals passed therethrough to help emphasize the extended stereo effect. Volume control 64 is coupled to a switch blade 74 which, as indicated by the dashed line, is arranged for simultaneous operation of switch blades 76 and 78. Switch blade 74 (and switch blades 76 and 78) has a SEQ off position and a SEQ ON position. In the SEQ off position, switch blades 74, 76 and 78 are open and the stereo extender (i.e. modified loudness) is disabled. That is, no out-of-phase coupling of left channel signal to the right channel and right channel signal to the left channel occurs, and the bass, treble and volume functions are independent. With the switch blade 74 in its SEQ on position, the output of inverter 68 is coupled to the input of summer 56 and the output of inverter 72 is coupled to the input of summer 46. In this position of the switch blades, a portion of the bandpassed right channel signal is inverted and coupled to the left channel output and a portion of the bandpassed left channel signal is inverted and coupled to the right channel output. This occurs through summers 46 and 56. Switch blade 74 operates to connect volume control 64 to bass control 60 and to treble control 62 for operating these controls jointly with operation of the volume control.

In operation and with SEQ off, the system functions with normal stereo audio signals, corresponding to L and R, being passed through the left and right channels and being controlled by independently acting bass, treble and volume controls, 60, 62 and 64, respectively. With SEQ on (switch blades 74, 76 and 78 in their active positions), the extended stereo means are activated for supplying a portion of bandpassed out-of-phase left channel signal to the right channel and a portion of bandpassed out-of-phase right channel signal to the left channel for emphasizing the stereo separation and for simultaneously connecting the bass and treble controls for conjoint operation with volume control 64 to enhance the frequency response characteristics of both the right and left channels and to alter the channel gains slightly. In practice, in the SEQ on position, the bass and treble frequencies are boosted with respect to mid frequencies and the audio level is decreased by about 3db. This combination of effects, i.e. of the stereo extender means being activated and the bass and treble responses being keyed to channel gain levels produces an effect heretofore not heard. The stereo sound seems to engulf the listener and produces a very pleasing effect. Experimentation and listening tests have shown that simultaneous operation of both the stereo extender means and the frequency characteristic response means is required to obtain this enhanced listening effect.

It will be appreciated of course that the stereo enhanced system need not be confined to a television receiver although that is its preferred implementation. It will also be appreciated that in a digital implementation, the bass, treble and volume controls are digitally implemented through microprocessor 12 and APU 22. In practice the frequency response contour curves for the bass and treble controls are obtained by means of lookup tables that are coordinated with gain control settings for the channels. Similarly, switch blades 74, 76 and 78 are electronically implemented.

It is recognized that numerous changes in the described embodiment of the invention will be apparent to those skilled in the art without departing from its true spirit and scope. The invention is to be limited only as defined in the claims.

What is claimed is:

1. An audio spatial equalization system comprising:

a volume control;

stereo amplifier means having left and right channels including respective left and right channel amplifiers under control of said volume control;

frequency control means for changing the relative high and low frequency response characteristic of said channel;

extended stereo means for supplying a phase inverted right signal to said left channel and for supplying a phase inverted left signal to said right channel; and switching means for simultaneously activating said extended stereo means and coupling said volume control to said frequency control means whereby said volume control effects changes in said frequency response characteristics of said channels.

2. The system of claim 1 wherein said frequency control means includes separate bass and treble control means for said channels; and wherein said switching means operatively couples said bass and treble means to said volume control.

3. The system of claim 2 wherein said extended stereo means includes:

bandpass means for supplying said phase inverted signals; and summation circuits in the outputs of said left and said right channel amplifiers for combining said phase inverted signals with said left and right channel signals, respectively.

4. The system of claim 3 wherein both the gain frequency response and low frequency response of said channels are increased when said switching means is operated.

5. An audio spatial equalization system comprising:

stereo amplifier means including left and right channels, each including bass, treble and volume control stages;

a volume control for adjusting said volume control stages;

extended stereo means for supplying a phase inverted signal from said right channel to said left channel and a phase inverted signal from said left channel to said right channel, said extended stereo means including bandpass means coupled to the outputs of said channels;

switching means for simultaneously activating said extended stereo means and for operatively coupling said bass and said treble control stages to said volume control; and summation circuits in the outputs of said channels for combining said phase inverted signals with corresponding signals in said left and said right channel signals, respectively.

6. In a digital television receiver system including a pair of remotely situated left and right loudspeakers, an audio spatial equalization system comprising:

volume control means including a volume control;

stereo amplifier means including left and right channel amplifiers for supplying said remote left and right loudspeakers;

bass and treble means for changing the relative high and low frequency response characteristics of said channels;

stereo extender means for supplying a phase inverted signal from said right channel to said left channel and a phase inverted signal from said left channel to said right channel; and switching means for simultaneously activating said stereo extender means and coupling said volume control to said bass treble means.

* * * * *